US007806293B2

(12) United States Patent
Altieri et al.

(10) Patent No.: US 7,806,293 B2
(45) Date of Patent: Oct. 5, 2010

(54) SHOTGUN SHELL STORING AND DISPENSING DEVICE

(76) Inventors: Daniel P. Altieri, 1573 Sheridan Rd., Coopersburg, PA (US) 18036; Andrew M. Truxel, 16 Valley View Rd., Warren, NJ (US) 07059

( * ) Notice: Subject to any disclaimer, the term of this patent is extended or adjusted under 35 U.S.C. 154(b) by 0 days.

(21) Appl. No.: 12/494,528

(22) Filed: Jun. 30, 2009

(65) Prior Publication Data

US 2009/0261119 A1 Oct. 22, 2009

Related U.S. Application Data

(63) Continuation-in-part of application No. 11/554,147, filed on Oct. 30, 2006, now abandoned.

(51) Int. Cl.
*B23Q 7/10* (2006.01)
*F42B 39/02* (2006.01)

(52) U.S. Cl. ..... 221/185; 221/241; 221/242; 221/279

(58) Field of Classification Search ..... 221/185, 221/208, 244, 260, 279
See application file for complete search history.

(56) References Cited

U.S. PATENT DOCUMENTS 313,856 A * 3/1885 Diss ..... 42/50
1,833,862 A * 11/1931 Hugo ..... 42/50
2,777,235 A * 1/1957 Hopkins ..... 42/50
3,087,270 A * 4/1963 Stoner ..... 42/50
3,219,244 A * 11/1965 Blask ..... 221/310
3,399,480 A * 9/1968 Rowe, Jr. ..... 42/50
4,027,415 A * 6/1977 Stoner ..... 42/50
4,106,668 A * 8/1978 Gebhardt et al. ..... 221/131
4,438,676 A * 3/1984 Kaustrater ..... 89/34
4,472,900 A * 9/1984 Howard ..... 42/50
4,580,364 A * 4/1986 Vyprachticky ..... 42/50
4,765,081 A * 8/1988 Dieringer ..... 42/50
5,099,595 A * 3/1992 Chesnut et al. ..... 42/50
5,111,964 A * 5/1992 Couper ..... 221/111
5,272,957 A * 12/1993 Chesnut et al. ..... 89/195
5,329,718 A * 7/1994 Howard ..... 42/50
6,817,135 B1 * 11/2004 Jackson ..... 42/87
2008/0167578 A1 * 7/2008 Bryer et al. ..... 600/583

* cited by examiner

*Primary Examiner*—Gene Crawford
*Assistant Examiner*—Kelvin L Randall, Jr.
(74) *Attorney, Agent, or Firm*—Design IP

(57) ABSTRACT

A shotgun shell storage and dispenser device in the form of a hollow elongated housing to hold the shotgun shells in vertical array, the housing adjusted for loading and dispensing shotgun shells through a loading end of the housing. Shotgun shells are positioned by structural elements on a rear wall of the housing and constant force springs in conjunction with a follower to urge the shotgun shells toward a loading and discharge end of the housing.

5 Claims, 9 Drawing Sheets

SHOTGUN SHELL STORING AND DISPENSING DEVICE

This application is a Continuation-in-Part of U.S. patent application Ser. No. 11/554,147 filed Oct. 30, 2006.

BACKGROUND OF THE INVENTION

The present invention pertains to the ability of a person engaged in use of a shotgun to have readily an accessible and easily dispensed quantity of shotgun shells. Such persons are normally engaged in law enforcement, the military or sporting endeavors such as skeet shooting, trap shooting and sporting clays.

Shotgun users that wish to carry ammunition in excess of that which is either designated capacity by the manufacturer of a shotgun such as a pump shotgun or an automatic shotgun or is limited by laws or regulations may wish to carry extra ammunition (shotgun shells) that can be readily available and readily dispensed for reloading the weapon.

The extra ammunition can be carried by such devices as a bandolier made from fabric with individual slings or pockets to carry shotgun shells. The bandolier is normally worn across the chest of the user from a shoulder to the waist. A similar device in the form of a belt worn around the waist of the user is also available.

Certain manufacturers offer a cover for a rifle or shotgun sling that can be adapted to carry extra shells. It is also possible to buy a flexible carrier or a rigid carrier that can be removably fastened to the stock of the shotgun to carry extra shells.

Belt patches as well as vests with pouches are also available to carry extra shotgun shells.

U.S. Pat. Nos. 2,837,258; 6,817,135 and 3,219,244 are representative of the state of the art.

BRIEF DESCRIPTION OF THE INVENTION

The present invention pertains to a shotgun shell storing and dispensing device that is in the form of an elongated hollow housing adapted to receive the shells in a generally horizontal array so that the user can select a shell from a bottom opening of the housing for rapid reloading of a shotgun. The housing includes means to urge the shells from a top or second end to the open bottom or first end of the housing to maintain the shells in position during transport and until the user calls for a shell.

Therefore, in one aspect the present invention is a device for storing and dispensing shotgun shells comprising: a generally elongated hollow housing having a generally rectangular shaped cross-section; the housing adapted to position shotgun shells in a generally vertical array with the longitudinal axis of each of the shotgun shells generally perpendicular to a long axis of the housing between opposite elongated sides of the housing; means on a first or dispensing end of the housing to prevent shells from falling out of the housing and to position each shotgun shell to be dispensed for easy grasp by a user; and a pair of constant force springs positioned on opposite sides of a follower movable between the first and second ends of the housing, the constant force springs and follower adapted to maintain said shotgun shells inside said device regardless of the orientation or movement of said device and to urge the shotgun shells toward the dispensing end of the housing for ready access by a user.

DETAILED DESCRIPTION OF THE PREFERRED EMBODIMENTS

Figure 1:
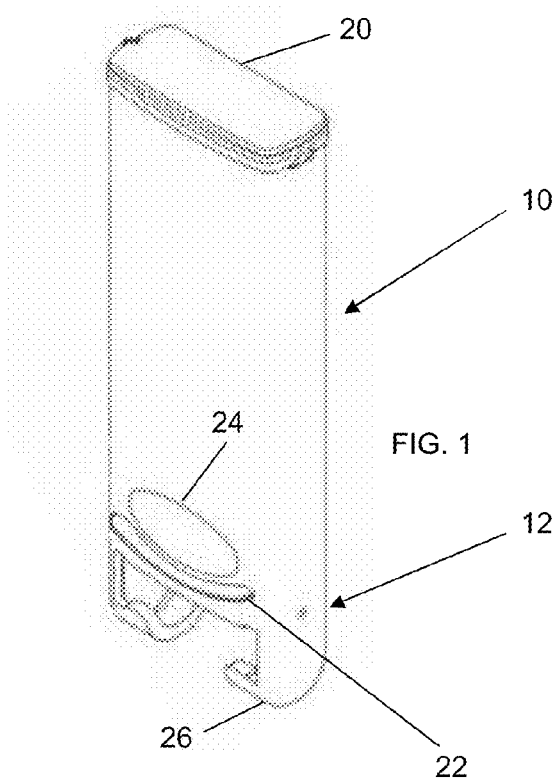
FIG. 1 is an isometric view of an apparatus according to the present invention.
Figure 4:
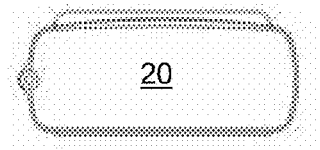
FIG. 4 is a top plan view of the device of FIG. 1.
Figure 3:
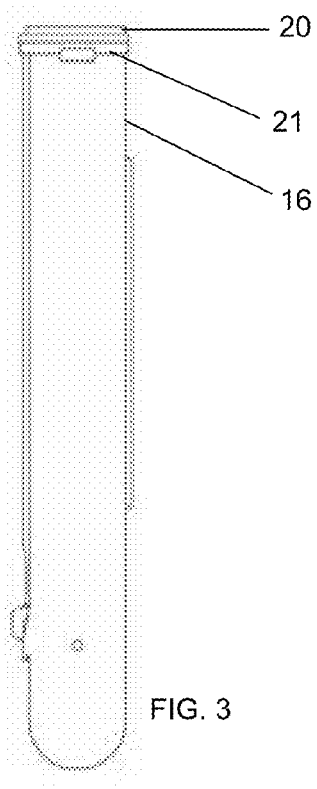
FIG. 3 is a right side view of the device of FIG. 1.
Figure 2:
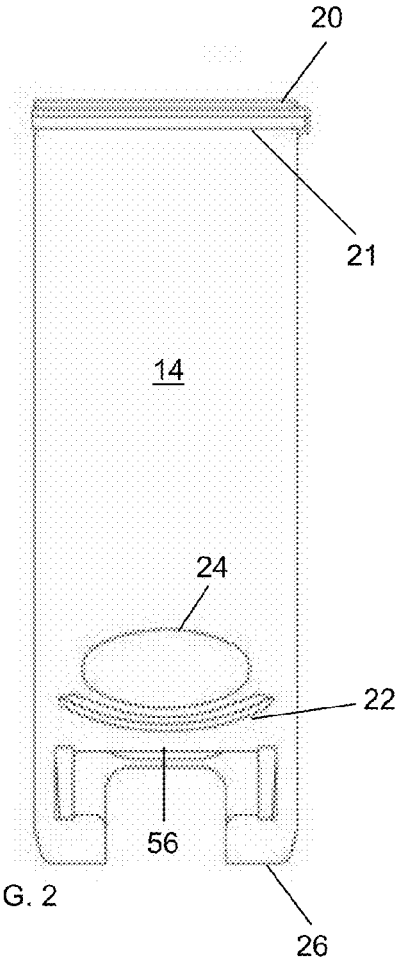
FIG. 2 is a front elevation view of the device of FIG. 1.

Referring to FIG. 1, FIG. 2 and FIG. 3, a shotgun shell carrying and dispensing device 10 according to one embodiment of the present invention has a housing 12 having a front or face portion 14 and a rear portion 16. The housing 12 can also be molded as a one piece unit.

Figure 5:
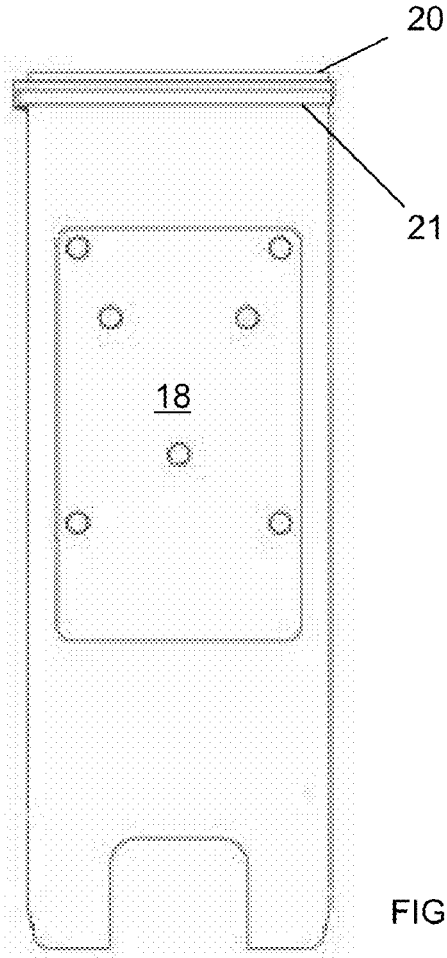
FIG. 5 is a rear elevational view of the device of FIG. 1.

The device 10 also includes a mechanical device generally illustrated as 18 (FIG. 5) so the user can fix the device 10 to an article of clothing such as a belt. Any of the known devices for attaching accessories or tools to the belt or clothing of a user can be adapted for this purpose. Device 10 can also be adapted to be carried by the stock of the shotgun. The device 10 includes a cover 20 on a top or second end 21 of the housing 12 and a thumb or finger grip 22 and receiver 24 on a bottom or first end 26 of the housing 12 to aid the user in dispensing a shell or shells.

Figure 6:
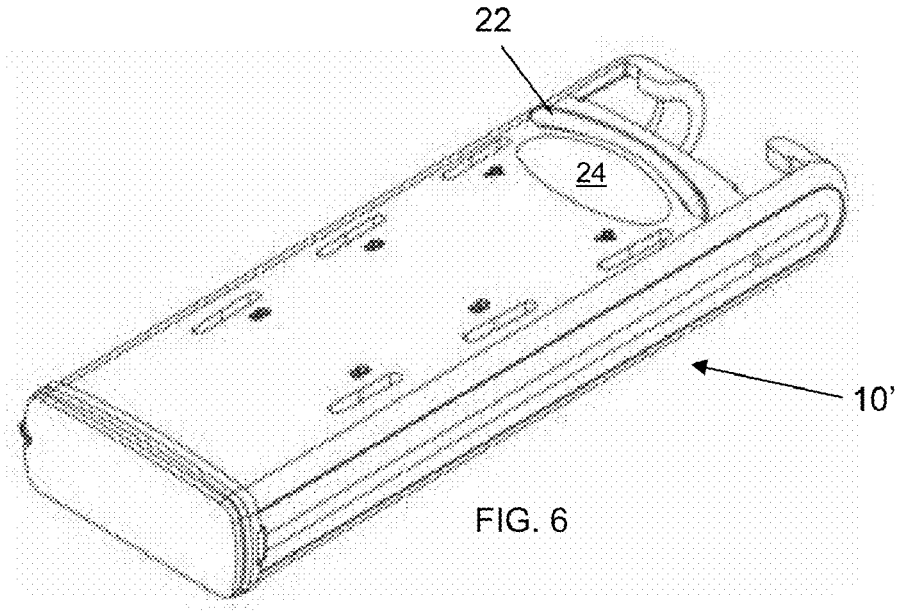
FIG. 6 is an isometric view of an alternate embodiment of the apparatus of the invention.
Figure 7:
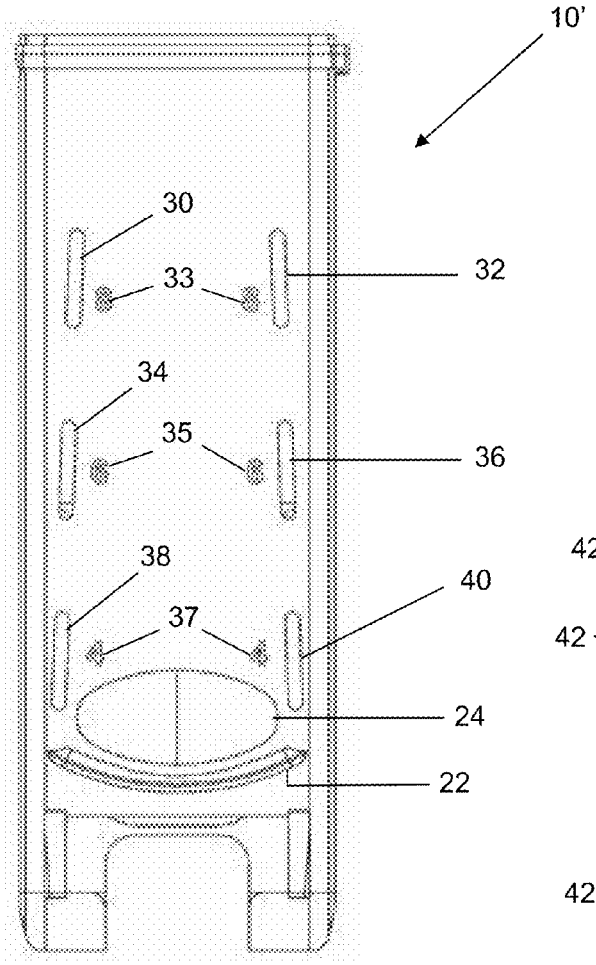
FIG. 7 is a front elevational view of the device of FIG. 6.

FIG. 6 and FIG. 7 illustrate another embodiment 10' of the device of FIG. 1 which includes means to identify the number of shotgun shells present in the case. The means of identification includes a plurality of slots or windows 30, 32 with numerical indicator 33, slots 34, 36 with numerical indicator 35, and slots 38, 40 with numerical indicator 37. With the slots or windows, a user will be able to rapidly determine how many shotgun shells have been loaded into the device 10 or dispensed therefrom.

Figure 8:
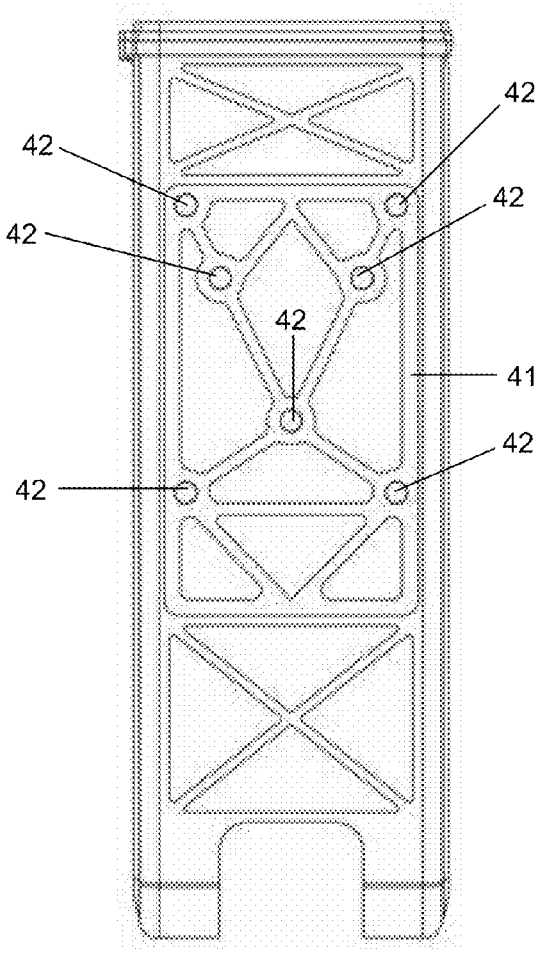
FIG. 8 is a rear elevational view of the device of FIG. 6.

As shown in FIG. 8 the back of device 10' can be fitted with a myriad of means 41 to attach the device to a user or other apparatus. The means 41 can consist of, for example, threaded receivers 42 which can receive a cover plate (not shown) fastened to the means 41 by suitable screws. The cover plate can be adapted to hold hooks, loops or any other convenient apparatus to fix the device 10, 10 to the clothing of the user or the user's shotgun.

Figure 9A:
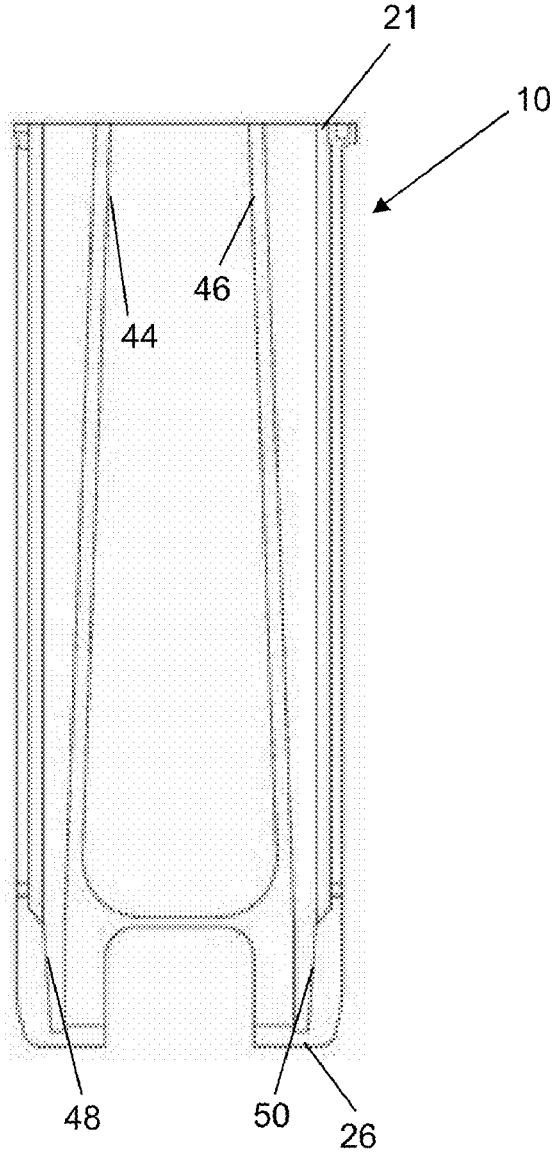
FIG. 9*a* is a front elevational view of a portion of the device shown in FIG. 1 or FIG. 6 illustrating interior details thereof.
Figure 9B:
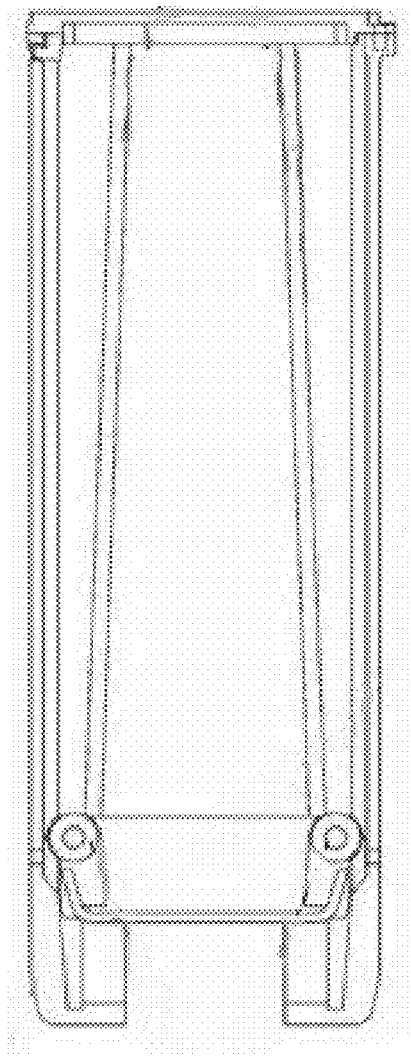
FIG. 9*b* is identical to FIG. 9 with the addition of a top, follower and constant force springs.

As shown in FIG. 9*a*, the front of housing 12 has been removed to illustrate a key feature of the device. As shown in FIG. 9*a*, a pair of raised ribs or rails 44, 46 are formed on a back wall of the housing 12 to add in maintaining the shotgun shells within the housing 12 without jamming, as will be discussed in more detail below. The rails 44,46 are angled from the second end 21 to the first end 26 of the device 10 with the rails spreading apart as they are positioned from second end 21 to first end 26. The interior portions 48, 50 proximate the first end 26 of housing 12 taper inwardly to aid in positioning the lowermost shotgun shell for rapid dispensing.

Figure 10:
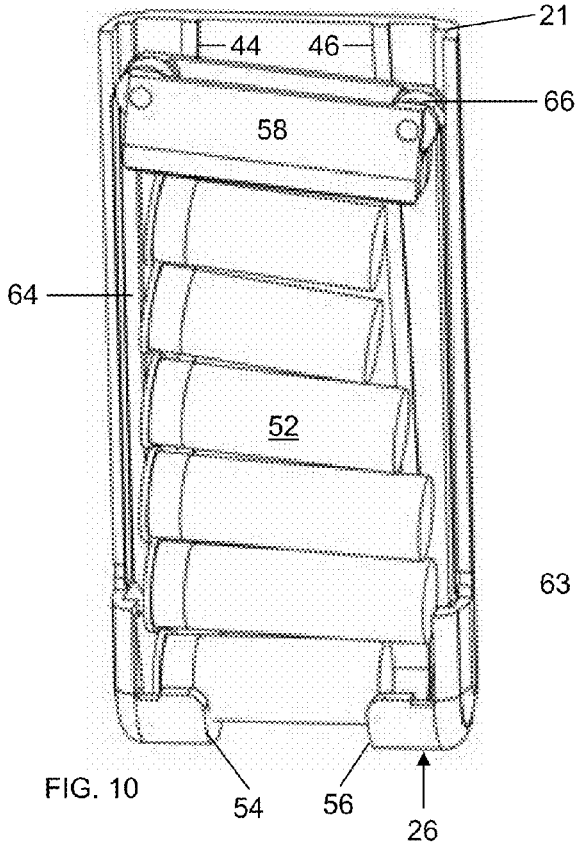
FIG. 10 is an enlarged perspective view of a portion of the device of FIG. 9 illustrating the follower assembly.
Figure 12A:
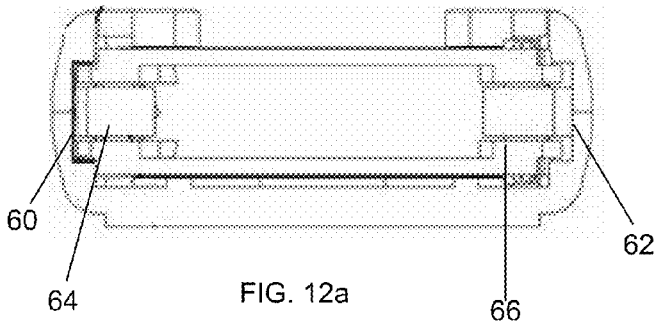
FIG. 12*a* is a top view of the device of FIG. 10.
Figure 12B:
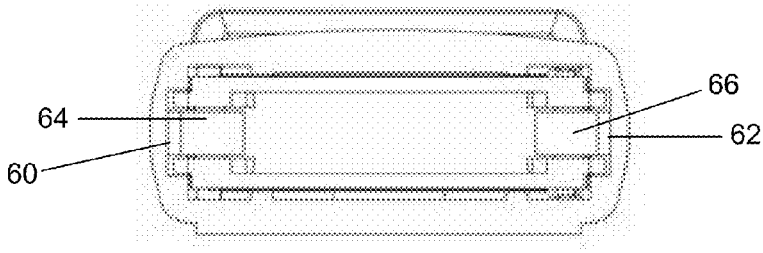
FIG. 12*b* is a top view of the device of FIG. 2 with its cover removed.

As shown in FIG. 10, a plurality of shotgun shells, one of which is illustrated by the numeral 52, are arrayed generally horizontally (relative to a vertical axis through the long dimension of the housing 12) from the first or dispensing end 26 to the cover or second end 21 of housing 12. As part of the features of the present invention for securely maintaining the position of the shotgun shells inside of the housing 12 by hooks or rounded portions 54, 56 formed in the first (discharge or dispensing) end 26 of the housing 12. The housing 12 includes a follower 58 which is moveable between the first 26 and second 21 ends of the housing 12. Housing 12 includes a pair of channels 60, 62 on opposite inside side walls of the housing 12 as shown in FIG. 12 where a portion of the front wall of housing 12 is removed and FIG. 13 where the full housing is shown. Follower 58 contains a pair of constant force springs 64, 66 such as part numbers SH4D15 or SH4E15 available from Vulcan Spring of Telford, Pa. A prototype device was constructed using the SH4D15 springs fabricated from Type 301 stainless steel. The springs were selected to provide secure holding of one to any number of the capacity of the shotgun shells inside the housing 12 without fear of the shotgun shells being prematurely ejected, regardless of the orientation of the housing 10. In other words, the force of the constant force springs is selected to achieve a secure loading resistant to shock, vibration or gravitational forces.

Figure 11:
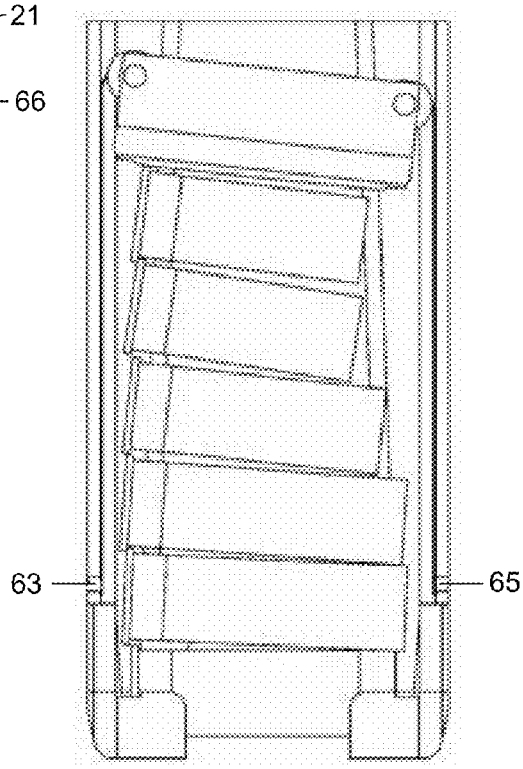
FIG. 11 is a front elevational view of the device of FIG. 10.

The constant force springs 64, 66 permit the follower 58 to tilt to accommodate shotgun shells positioned at an angle as shown in FIG. 10. The follower 58 is shaped so that the constant force springs 64, 66 will not contact or jam the follower 58 if it is not longitudinally dispersed, i.e. tilted as shown in FIG. 10 and FIG. 11. The constant force springs 64, 66 are disposed in channels 60, 62 respectively, each having a free end (63, 65) respectively fastened to a corresponding side of housing 12 as shown in FIG. 11. The free ends 63, 65 of constant force springs 64, 66 can be fastened by rivets, screws, hooks or any other convenient means. The coiled portion of the constant force springs 64, 66 on the follower 58 helps maintain the position of the constant force springs 64, 66 in their respective grooves or channels 60, 62.

Figure 13A:
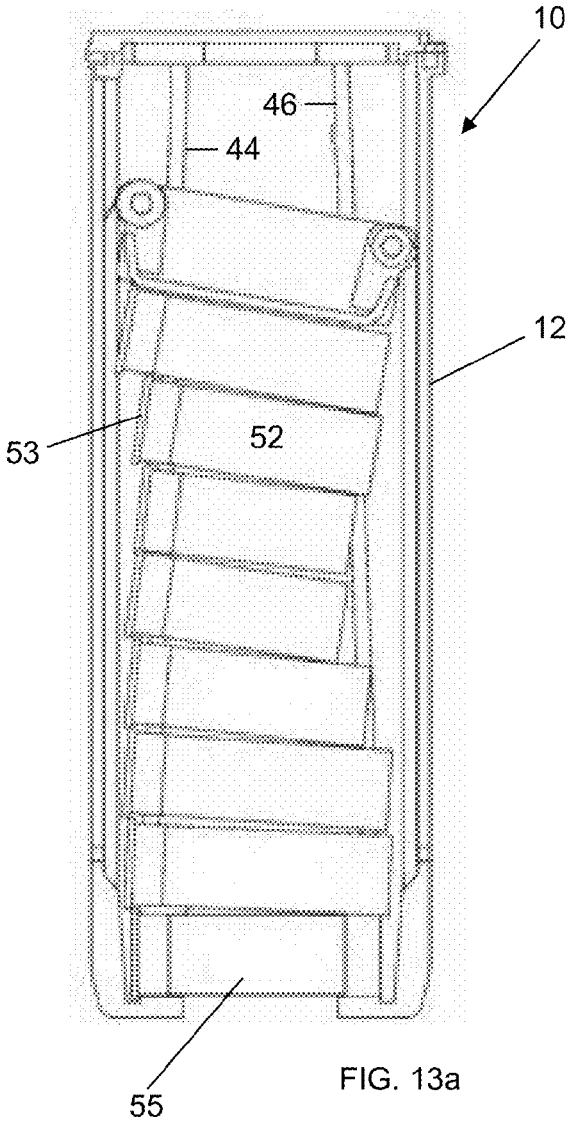
FIG. 13*a* is identical to FIG. 9*a* with the addition of shotgun shells in positions of storage and dispensing.
Figure 13B:
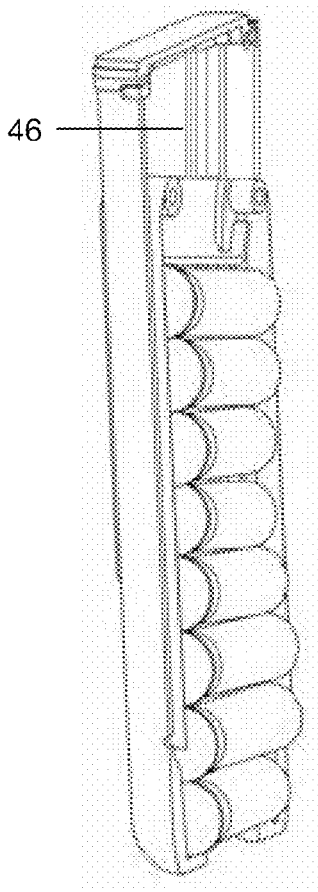
FIG. 13*b* is an isometric view of the device of FIG. 13*a*.

As shown in FIG. 10, FIG. 13*a* and FIG. 13*b*, the shotgun shells 52, 55 can be loaded with the rim of each shotgun shell 53 placed on the same side of the housing, the slight angular disposition of the shotgun shells will not cause the shotgun shells to jam or not move down in the housing 12.

The shotgun shells can be loaded with the rims left or right relative to the longitudinal axis of the housing 12 or with the shotgun shells loaded alternately left or right without jamming. The shotgun shells are kept in a generally horizontal position in a vertical array as illustrated. Furthermore as illustrated in FIG. 13*a*, shotgun shells of varying lengths or gauges can be loaded at one time.

Referring to FIG. 9*a*, the tapered portions 48, 50 of housing 12 position the lowermost shell, (e.g. 55) in a horizontal position for dispensing.

Referring to FIG. 10, FIG. 13*a* and FIG. 13*b*, the rails or vertical projections 44, 46 in conjunction with the follower 58 and constant force springs 64, 66 maintain the position of the shotgun shells without jamming and permit ready movement of the shells down the device 10 or 10' to the dispensing end 26. The rails 44, 46 are positioned so that the various lengths of shotgun shells of any gauge can be held in the housing as illustrated in FIG. 13*a* where shotgun shells are of varying lengths are depicted. Users thus can load shells of varying lengths without fear of shotgun shells jamming inside of the housing.

FIG. 1, FIG. 2, FIG. 6 and FIG. 7 illustrate the device 10 of 10' having a ridge or thumb holder 22 and recess 24 located to assist the user in extracting shells from the device 10.

Figure 14A:
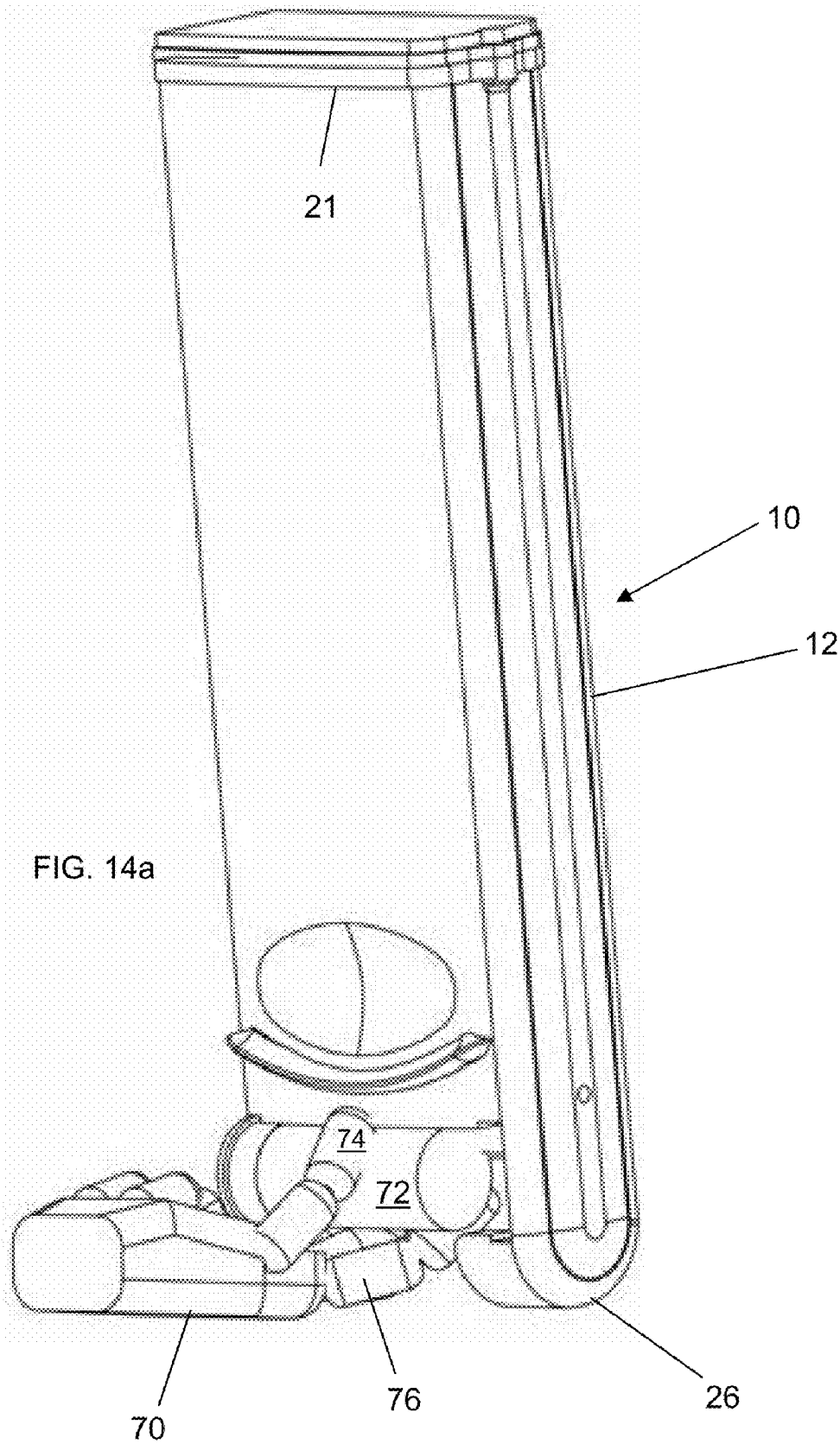
FIG. 14*a* is an enlarged perspective view of the device of FIG. 1 illustrating in schematic form loading of shotgun shells into a device according to the present invention.
Figure 14B:
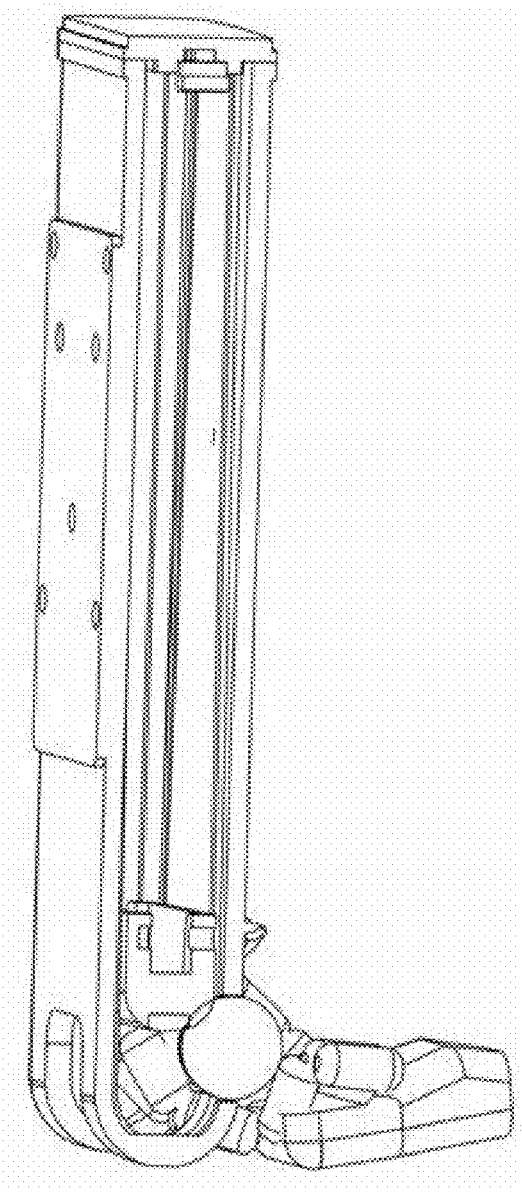
FIG. 14*b* is a fragmented left side view of the device of FIG. 14*a*.

FIG. 14*a* and FIG. 14*b* are schematic illustrations of the device of the invention being loaded with shotgun shells. The user's hand 70 grips each shotgun shell 72 using the thumb 74 and one or more fingers, e.g. index finger 76 and places it inside housing 12 forcing the follower 58 upwardly inside the housing 12. The constant force springs 64, 66 position the first shotgun shell 72 inserted into the housing 12 in a generally horizontal position as shown with the lowermost shotgun shell 55 in FIG. 13*a*. As subsequent shotgun shells are placed into housing 12 the previously loaded shotgun shells and follower are urged upwardly from the end 26 to end 21 of housing 12. Here again the follower 58 and constant force springs 64, 66, in conjunction with rails 44, 46, maintain the loaded shotgun shells within housing 12.

The shotgun shells loaded into the housing 12 of device 10 are firmly held so that they are not prematurely ejected if the housing 12 is oriented with the end 26 pointing downward toward a user's feet, or at another angle. The device of the invention can be oriented so end 26 is in an upward position for a user to extract shotgun shells.

A device according to the present invention has been loaded with shotgun shells and a user has carried the device while running, jumping, falling through thick under bush, etc. without having shotgun shells ejected from the device.

Figure 15B:
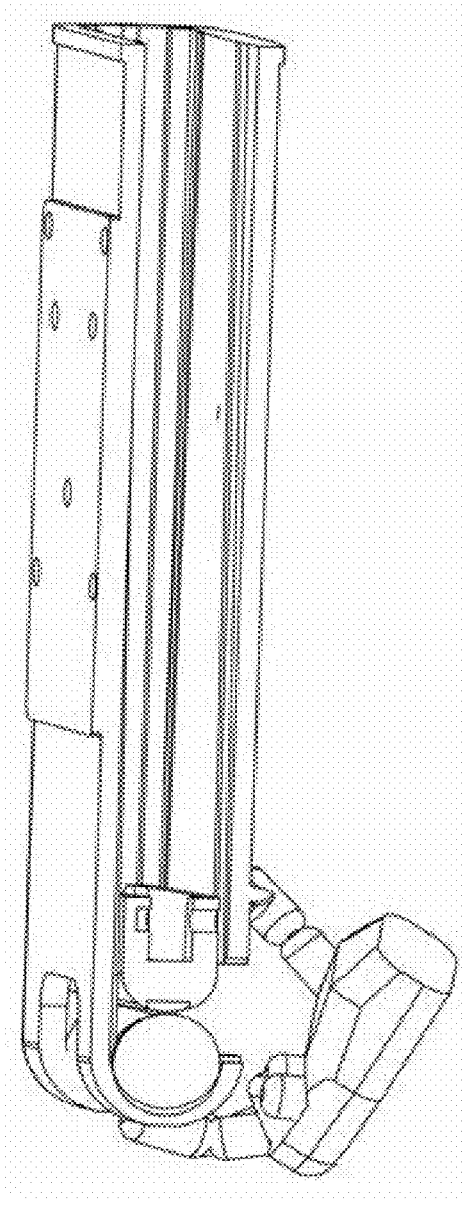
FIG. 15*b* is a fragmented left side view of the device of FIG. 15*a*.
Figure 15A:
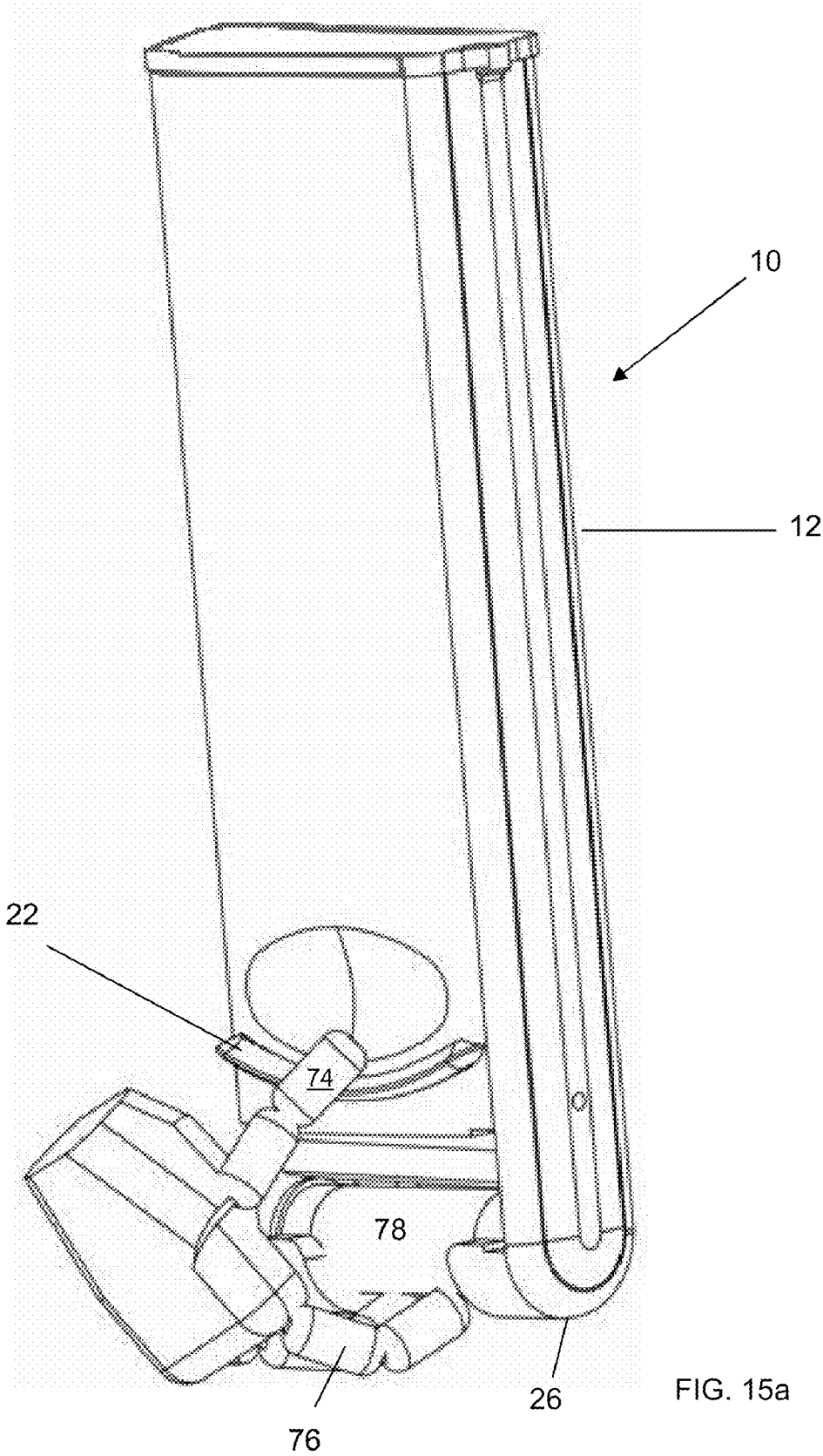
FIG. 15*a* is an enlarged perspective view of the device of FIG. 1 illustrating in schematic form dispensing of a shotgun shell into the hand of a user.

FIG. 15*a* and FIG. 15*b* are schematic illustrations of the device 10 according to the present invention dispensing a shotgun shell from a previously loaded housing 12 into the hand 70 of the user. The user can rest his thumb 74 on the rib 22 and use one or more of his fingers (e.g. index finger 76) to extract a shotgun shell 78 from the housing 12. As one shotgun shell is extracted, the remaining shotgun shells are urged or move toward end 26 of housing 12 to be ready when needed. Here again the constant force springs 64, 66, follower 58 and rails 44, 46 maintain the shotgun shells remaining in the case in position for movement without jamming the remaining shotgun shells inside housing 12.

A device according to the present invention is adapted to hold and dispense different gauges of shotgun shells (e.g. 20, 12, 10 gauge). The number of shotgun shells that can be held and dispensed can be varied from 1 to 25 depending upon the length of the housing 12.

A device according to the present invention can be fabricated as a solid structure to be weather proof and water proof and to protect the shotgun shells. With few moving parts a case according to the invention will have increased use and durability.

A device according to the present invention can be used by either a right or left handed shotgun user.

A device according to the present invention does not require special structure, e.g. grooves on the inside side walls of the case to grip the rim of the shotgun shells in order to maintain the vertical array of the generally horizontally disposed shotgun shells. A device according to the invention has a removable lid for servicing but is loaded and unloaded through the bottom of housing 12.

In a preferred embodiment the curved dispensing fingers can be constructed to support half the length of one shotgun shell. The width of the dispensing gap occurring between the top edge of the curved region and the bottom edge of the front wall of the housing is arranged to be large enough for only one shotgun shell to dispense at a time and is positioned so that when the dispenser is not being accessed, the bottom shotgun shell and those above it are held in position. Thus no shotgun shell leaves the device without the upward/outward motion required to dispense the shotgun shells.

The forgoing description provides illustrative embodiments of the present invention, and is not intended to limit the scope, applicability, or configuration of the invention. The description of the embodiments of the invention will provide those skilled in the art with an enabling description for implementing the invention. It should be understood that various changes may be made in the function and arrangement of elements without departing from the spirit and scope of the invention.

Having thus described our invention what is desired to be secured by Letters Patent of the United States is set forth in the appended claims.

What is claimed is:

1. A device for storing and dispensing shotgun shells comprising:

a generally elongated hollow housing having a generally rectangular shaped cross-section, a first and second end, said housing having means to position shotgun shells in a vertical array with the longitudinal axis of each of said shotgun shells generally perpendicular to a longitudinal axis of said housing;

said means including a pair of rails formed on a back wall of said housing, said rails angled from said second end to said first end with said rails spreading apart as they extend from said second end to said first end;

means on said first end of said housing to permit shotgun shells to be manually loaded and unloaded from said housing by a user; and a follower moveably positioned inside of said housing by a pair of constant force springs, each of said constant force springs disposed in a channel on opposite sides inside of said housing with each of said constant force springs extending inside said channel on respective sides of said housing from a location proximate said first end of said housing with a second end coiled about an axis on said follower inside said housing said follower so constructed and arranged to tilt at an angle relative to said longitudinal axis of said housing to maintain a constant force on said shells in said case.

2. A device according to claim 1 wherein a front wall portion of said housing extends from said second end to a position above said first end of said housing.

3. A device according to claim 1 including a means to attach said housing to one of an article of clothing worn by a user, a belt, a bandolier or a shotgun.

4. A device according to claim 1 including a moveable cover fitted to said second end of said housing.

5. A device according to claim 1 including a housing adjusted to store and dispense from 1 to 25 shotgun shells.

* * * * *